US005277302A

United States Patent [19]

Seisa

[11] Patent Number: 5,277,302

[45] Date of Patent: Jan. 11, 1994

[54] COMBINATION PAINT PALETTE AND STORAGE DEVICE

[75] Inventor: Jon S. Seisa, Long Beach, Calif.

[73] Assignee: Mattel, Inc., El Segundo, Calif.

[21] Appl. No.: 832,274

[22] Filed: Feb. 7, 1992

[51] Int. Cl.[5] ..... B65D 85/00

[52] U.S. Cl. ..... 206/1.8; 206/457; 206/459.1

[58] Field of Search ..... 206/1.7–1.9, 209, 361, 362, 459.1, 211/65; 69.5, 69.7; 206/457

[56] References Cited

U.S. PATENT DOCUMENTS

| | | | |
|---|---|---|---|
| 2,160,661 | 5/1939 | Hudtt | 211/69.6 |
| 3,650,380 | 3/1972 | Hutchinson | 206/1.8 |
| 4,573,569 | 3/1986 | Parker | 206/1.7 |
| 4,669,617 | 6/1987 | Boeckmann et al. | 211/69.7 |
| 4,735,306 | 4/1988 | Smit | 206/1.8 |
| 4,947,984 | 8/1990 | Kaufman et al. | 206/1.7 |
| 5,107,984 | 4/1992 | Welschoff | 206/823 |

FOREIGN PATENT DOCUMENTS

| | | | |
|---|---|---|---|
| 0303614 | 1/1929 | United Kingdom | 206/1.8 |

*Primary Examiner*—Jimmy G. Foster
*Attorney, Agent, or Firm*—Roy A. Ekstrand

[57] ABSTRACT

A combination paint palette and storage device includes a generally planar palette base having a thumb aperture and hand grip defined therein. The palette base further defines a plurality of paint mixing recesses and supports a rotating wheel color mix display chart. A plurality of paint applicators are received and supported within a corresponding plurality of applicator caps. The applicator caps are secured to the palette base in a ball and socket attachment using a corresponding plurality of simulated paint deposits which are color coated to the applicator paint color. A storage bracket is supported upon the undersurface of the planar palette base and accommodates and stores a plurality of paint media sheets.

5 Claims, 2 Drawing Sheets

COMBINATION PAINT PALETTE AND STORAGE DEVICE

FIELD OF THE INVENTION

This invention relates generally to painting apparatus and particularly to artists' palettes and similar articles.

BACKGROUND OF THE INVENTION

One of the most commonly used and most well known devices among artists and art suppliers is that generally referred to as a paint palette. The traditional paint palette is extremely pervasive and generally recognizable by most individuals. Generally, paint palettes comprise a planar member formed in a distinctive elliptical-type shape having a thumb aperture and hand accommodating concave curve portion. The planar surface is generally used to receive a plurality of oil paints. In addition, the artist typically uses the remaining surface area of the palette to mix various colors and blends of paints. With the continued use of paint palettes, a number of related devices have been produced which resemble traditional paint palettes but employ certain improvements and variations. These variations have included the provision of sealable paint receptacles spaced about the otherwise traditional paint palette as well as the use of paper pads secured to a portion of the paint palette to provide disposable mixing surfaces for paint mixing and blending. In addition, a number of accessories such as removable palette covers and covers for individual paint deposits have been provided to assist users of such palettes.

Toy manufacturers have also frequently provided various replicas and fanciful replicas of painting palettes to be used by younger children and the like. These toy replicas as well as the above-described variations and changes provided for traditional paint palettes have provided substantial variation of palettes available to the consumer.

U.S Pat. No. 4,858,955 issued to Holt sets forth a PALETTE WITH DISPOSABLE MIXING SURFACE FOR MIXING BLENDABLE MATERIALS in which a generally rectangular palette having a planar shape is provided with a thumb aperture and concave edge proximate thereto for gripping in the user's hand. The palette further includes a plurality of disposable mixing sheets secured in a tablet-like arrangement upon the palette upper surface. Intended use provides for mixing upon the topmost of the disposable sheets and discarding the topmost sheet once used to expose a new sheet underlying it in a renewable fashion.

U.S. Pat. No. 4,735,306 issued to Smit sets forth a PALETTE WITH PAINT RECEPTACLES in which a palette shaped painter's implement includes a planar base having a shape similar to a traditional paint palette. A plurality of paint receptacles having interior cavities for receiving and holding paint quantities are securable to the palette surface to make paint available to the user.

U.S Pat. No. 3,945,490 issued to Thompson sets forth a COVERED ARTIST PALETTE APPARATUS in which an artist palette is provided with a correspondingly shaped matable cover for sealing the palette surface and preventing paint drying during periods of non-use. A palette pad, having a plurality of disposable sheets, is configured to be received upon the palette and supported thereon beneath the palette cover.

U.S. Pat. No. 3,779,369 issued to Lang sets forth an ART PAINT SAVER for use with a conventional artist's palette having a paint bearing surface. The paint saver comprises a hollow cup-like member having a peripheral flange surrounding the opening portion thereof. Adhesive means are disposed on the flange for detachably securing the cup-like member to the palette with the opening in contact with the palette and enclosing the paint portion therein.

U.S. Pat. No. 1,484,613 issued to Carmel sets forth PALETTE having a generally planar palette shaped base defining a plurality of apertures therein. A corresponding plurality of cu-shaped receptacles are removably received within the apertures and form paint receptacles. A recess supports a paintbrush and a centrally located marker holder receives a plurality of generally cylindrical markers in a radial arrangement.

U.S. Pat. No. 4,884,680 issued to Israel, et al. sets forth a COSMETIC DISPLAY in which a palette shaped support element supports an array of cosmetic material receptacles on the upper surface thereof. The cosmetic receptacles are each individually sealed by peel-off sealing foils.

U.S. Pat. No. 1,205,779 issued to Peck sets forth a CHILD'S PAINTING OUTFIT in which a generally rectangular housing supports a pageable book having a plurality of paintable sheets therein and a quantity of paint receptacles in a double row along side one edge of the pageable book. A covering lid is provided to enclose the paint materials.

U.S Pat. No. Des. 219,785 issued to Sallak sets forth a COLOR TEACHING AID having a housing defining a general palette-like shape and having extending generally vertical support sidewalls corresponding in contour to the outer edge shape of the palette-like portion. A plurality of circular objects are supported upon the upper surface of the palette-shaped member.

U.S. Pat. No. 2,820,233 issued to Steiner entitled FOUNTAIN PAINT BRUSH and U.S. Pat. No. 4,594,015 issued to Pomares and entitled PAINT APPLICATOR set forth paint marker and applicator devices suitable for use on a paper medium or the like.

While the foregoing described prior art devices have provided useful apparatus for many types of artistic activity, they have generally proven unsuitable for use by small children and the like. In addition, the prior art devices have generally lacked the amusement and interest value critical to successful involvement with younger children. Accordingly, there remains a continuing need in the art for evermore improved and entertaining artistic activity devices.

SUMMARY OF THE INVENTION

Accordingly, it is a general object of the present invention to provide an improved paint palette. It is a more particular object of the present invention to provide an improved paint palette which presents a more interesting and useable artistic activity for use by younger children. It is a still more particular object of the present invention to provide an improved paint palette which also serves as a convenient storage device for artistic materials.

In accordance with the present invention, there is provided a combination paint palette and storage device comprises: a generally planar palette base defining an upper surface and a lower surface; a plurality of paint applicators each having applicator tips; and a plurality of paint applicator receptacles pivotally secured to the palette base and configured to receive the applicator tips of the paint applicators.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
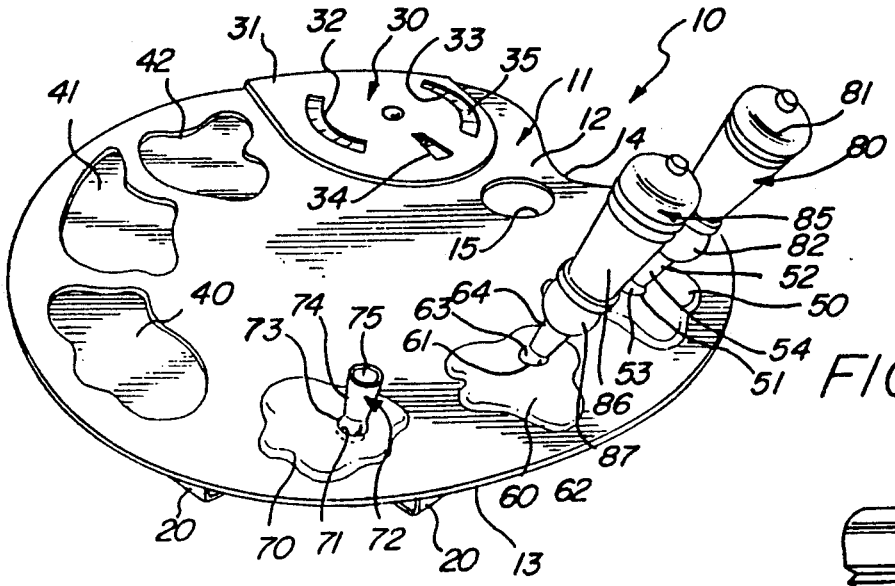
FIG. 1 sets forth a perspective view of a combination paint palette and storage device constructed in accordance with the present invention.
Figure 2:
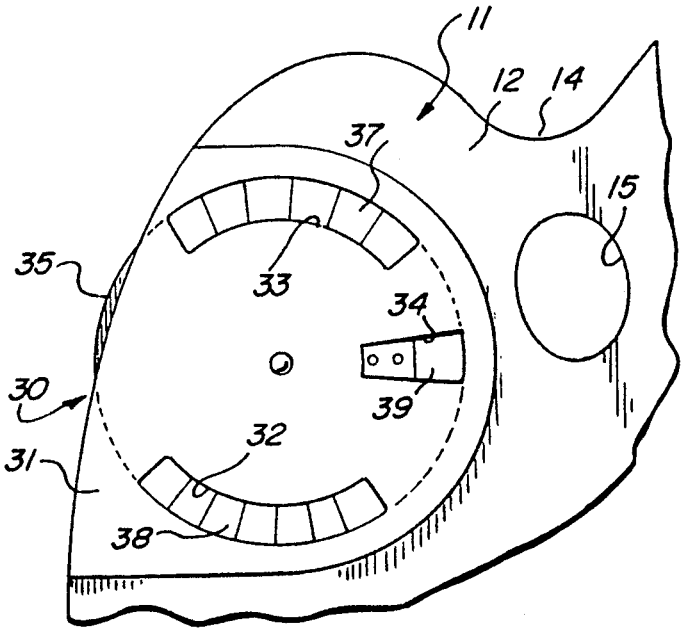
FIG. 2 sets forth a partial top view of a portion of the present invention combination paint palette and storage device.
Figure 4:
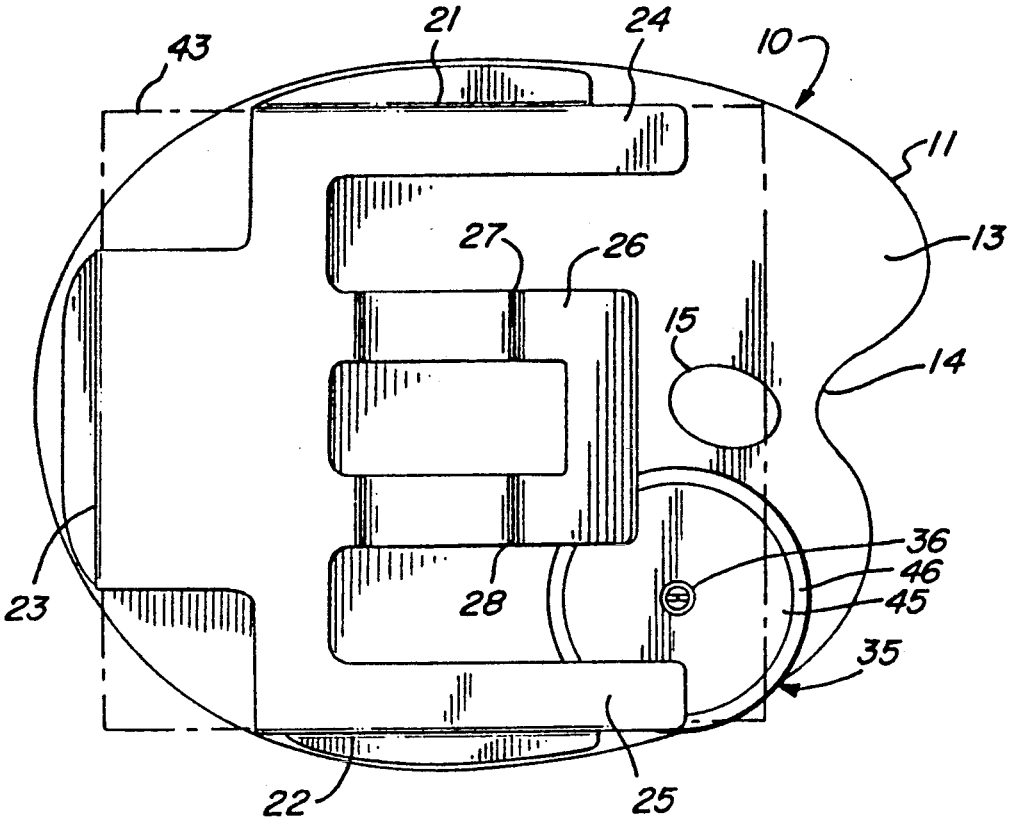
FIG. 4 sets forth a bottom view of the present invention combination paint palette and storage device.
Figure 5:
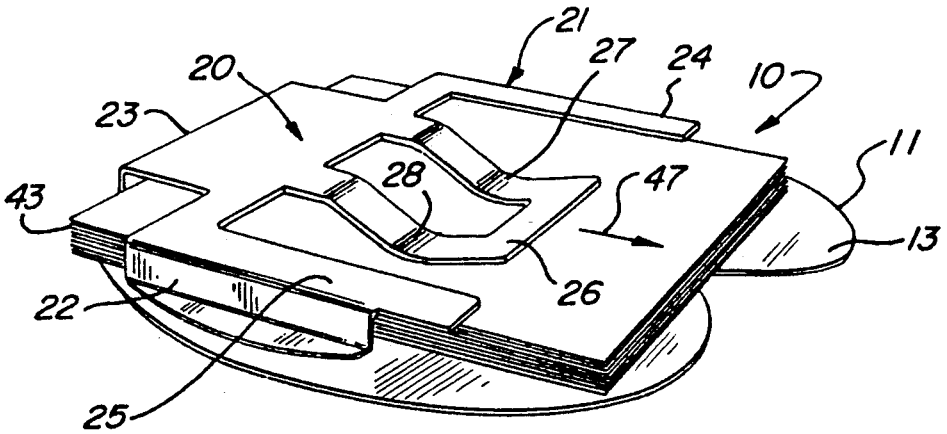
FIG. 5 sets forth a perspective view of the underside of the present invention combination paint palette and storage device.

FIG. 1 sets forth a perspective view of a paint palette and storage device constructed in accordance with the present invention and generally referenced by numeral 10. Device 10 includes a generally planar palette paint 11 defining an upper surface 12 and an undersurface 13. A storage bracket 20, the structure of which is better seen in FIGS. 4 and 5, is secured to undersurface 13. Upper surface 12 defines a plurality of irregularly shaped shallow mixing recesses 40, 41 and 42. A color mixture display chart 30 includes a generally planar cover 31 defining a plurality of window apertures 32, 33 and 34 therein. A circular color wheel 35, better seen in FIG. 2, is rotatably supported beneath cover 31 and is viewable in part through windows 32 33 and 34.

A plurality of simulated irregularly shaped paint deposits, 50, 60 and 70 are formed upon and supported by upper surface 12 in a spaced apart arrangement. Simulated paint deposits 50, 60 and 70 are, in their preferred form shaped to resemble paint deposit or blobs each having different colors such as the primary mixing colors. Paint blob 50 defines a socket recess 51 which receives an applicator cap 52 in an attachment set forth below in FIG. 3 in greater detail. However, suffice it to here that applicator cap 52 is securely received within socket 51 and while angularly movable therein, tends to retain the angular position at which it was last positioned. A paint applicator 80 includes a hollow bottle 81 supporting a quantity of paint or similar pigmented liquid material therein. Applicator 80 further includes a cap 82 and a tapered tip 83 which terminates in a soft applicator nib 84 (tip 83 and nip 84 better seen in FIG. 3). Paint applicator 80 is received within applicator cap 52 in a snap-fit insertion of tip 83 and nib 84 therein and held thereby with sufficient attachment to retain paint applicator in the position shown in FIG. 1.

Figure 3:
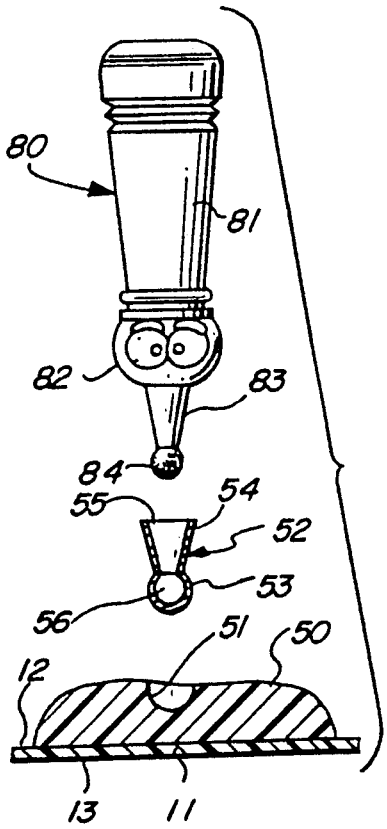
FIG. 3 sets forth a section view of a portion of the present invention combination paint palette and storage device taken along section lines 3—3 in FIG. 1.

Simulated paint deposits 60 and 70 are fabricated in a similar manner forming spherical sockets 61 and 71. By way of further similarity, a pair of applicator caps 62 and 72 configured in the same shape as applicator 52 shown in FIG. 3 are received within sockets 61 and 71 in a snap-fit attachment. In the configuration shown in FIG. 1, a paint applicator 85 includes a hollow bottle 86 having a cap 87 secured the reto. In similar manner to that described above for applicator 80, applicator 85 includes a generally cone-shaped tip and resilient nib generally conforming to tip 83 and nib 84 of applicator 80 which are received within applicator cap 62 in a secure snap-in attachment. Thus, paint applicator 85 is securely maintained in the position shown in a similar manner to paint applicator 80.

For purposes of illustration, applicator cap 72 is shown empty, that is, without an inserted paint applicator such as applicators 80 and 85 received within applicator caps 52 and 62 respectively. However, it will be apparent to those skilled in the art that a third paint applicator similar to applicators 80 and 85 may, if desired, be received within applicator cap 72 providing storage for three paint applicators which, in their preferred form, correspond to the three primary colors used in color mixing. It will be equally apparent to those skilled in the art, however, that while the example of the present invention paint palette and storage device set forth in FIG. 1 utilizes three paint applicators and corresponding supports therefor upon palette base 11, a different number of applicators and supports may be provided without departing from the spirit and scope of the present invention.

Storage bracket 20 is set forth below in greater detail and described in connection with FIGS. 4 and 5. However, suffice it to note here that in accordance with an important aspect of the present invention, storage bracket 20 accommodates convenient storage of a plurality of paint media sheets such as paper, cardboard or the like.

In the anticipated use of the present invention paint palette and storage device, paint applicators such as applicators 80 and 85 are maintained within their corresponding applicator caps for convenient access when not in use. During normal painting activities, one or more applicators is conveniently withdrawn from its applicator cap and may be used to color directly upon a sheet of painting media or other convenient surface to impart a color thereto. In addition, the paint applicators may be used to deposit a quantity of the paint contained therein within one or more of mixing recesses 40 through 42. Through skillful use of deposited quantities of paint within mixing recesses 40 through 42, the user may mix virtually any desired color. To assist in this activity, color mix display 30 provides coordinated information in the manner set forth below which assists the user in activities such as color mixing. Suffice it to note here, however, that information is provided to the user by moving color wheel 35 (seen in FIG. 2) to the selected position by viewing windows 32 through 34 and thereafter referring to windows 32 to 34 to obtain the desired color mixing information. In accordance with an important aspect of the present invention, the color mixing information is provided directly to the user through convenient color areas upon color wheel 35 without the need to read any material. Thus, color mix display 30, in its preferred form, is configured to operate in a manner providing information to child users to young to read text material but sufficiently advance to recognize colors and participate in painting activities or the like.

In further accordance with an important aspect of the present invention, storage bracket 20 supports the abovementioned plurality of media sheets which may include unused sheets and/or painted media sheets which are desired to be saved for convenient storage and transport. By way of further advantage of the present invention, the angular positions of applicator caps 52 may be adjusted to position the paint applicators supported therein in a generally horizontal arrangement overlying upper surface 12 and generally parallel to base 11. As a result, a convenient storage configuration is provided by paint palette and storage device 10 which facilitates easy storage and transport of the present invention device.

FIG. 2 sets forth a partial top view of the present invention paint palette and storage device showing a more detailed view of color mix display 30. As described above, palette base 11 defines a generally planar member having an upper surface 12, a thumb aperture 15 and a hand grip 14 defined therein. A color wheel 35 having a plurality of color areas such as color areas 37, 38 and 39 formed thereon is rotatably supported upon palette base 11 by a center pivot 36. A display cover 31 includes a generally planar member having a pair of oppositely positioned arcuate windows 32 and 33 on either side thereof together with a center window 33 interposed therebetween.

The structure and operation of color mix display 30 is, to some extent, a matter of design choice. However, it has been found advantageous to form color areas upon color wheel 35 which are viewable through windows 32 through 34 to provide coordinated color information. For example, the colored areas 37 and 38 viewable through windows 33 and 32 respectively together with colored area 39 viewable through window 34 may be spatially coordinated to provide color mix or tinting information to the user.

FIG. 3 sets forth a section view of paint palette and storage device 10 taken along section lines 3—3 in FIG. 1. Palette base 11 defines a generally planar member having an upper surface 12 and an undersurface 13. A simulated paint deposit 50 is formed upon and attached to upper surface 12 of palette base 11 by conventional attachment means such as adhesive bonding or thermal welding. Simulated paint deposit 50 is preferably formed of a resilient plastic material or the like and defines a spherically shaped internal socket 51. An applicator cap 52 defines a spherical ball portion 53 and a frusto-conical receptacle 54 integrally formed therewith. Receptacle 54, in turn, defines a generally conical tip chamber 55 while spherical ball 53 defines an interior nib chamber 56. Spherical ball 53 and socket 51 are respectively sized and configured to permit spherical ball 53 to be received within socket 51 in a snap-fit firm attachment in which ball 53 frictionally engages the interior wall of socket 51 and, in its preferred form, permits angular motion of applicator cap 52 which is subject to substantial resistance and thus tends to maintain applicator cap 52 at virtually any angular position in which the user places it. In addition, in its preferred form, applicator cap 52 is removable from socket 51 by the application of a substantial drawing force to the applicator cap which, due to the resilience of simulated paint deposit 50, permits withdrawal of ball 53 from socket 51. This permits applicator cap 52 to be utilized apart from palette and storage device 10 as a convenient cap for paint applicator 80 Paint applicator 80 includes a hollow body 81 having an interior cavity (not shown) for receiving and storing a quantity of paint or other pigmented material. Applicator 80 further includes a removable cap 82 having an applicator tip 83 formed in a frusto-conical shape and supporting a porous nib 84 at the extreme end thereof. Frusto-conical tip 83 is sized and shaped to fit within tip chamber 55 of applicator cap 52. Cap 82 and tip 83 define an interior passage (not shown) which communicates the interior paint reservoir of body 81 to nib 84 thereby permitting the flow of paint from body 81 to nib 84 when applicator 80 is in a generally inverted position.

Thus, applicator cap 52, when received within socket 51, provides a convenient and interesting means for retaining and storing applicator 80. It should be understood by those skilled in the art that simulated paint deposits 60 and 70 which support applicator caps 62 and 72 respectively are virtually identical to the structure set forth in FIG. 3 and thus the descriptions set forth above for FIG. 3 apply equally well to simulated paint deposits 60 and 70 as well as applicator caps 62 and 72.

FIG. 4 sets forth a bottom view of paint palette and storage device 10. Device 10, as described above, includes a generally planar palette base 11 defining a thumb aperture 15 and a hand grip portion 14. Palette base 11 further defines a generally planar undersurface 13. A color wheel 35 comprises a compound chart wheel formed of a pair of concentric circular wheels 45 and 46. A pivot 36 secures concentric wheels 45 and 46 to palette base 11 in accordance with conventional fabrication techniques.

In accordance with an important aspect of the present invention, a storage bracket 20 includes a pair of sidewalls 21 and 22 together with a back wall 23 which extend to and are secured to undersurface 13 of palette base 11. Storage bracket 20 includes a pair of edge guides 24 and 25 which extend inwardly from sidewalls 21 and 22 respectively. Storage bracket 20 further includes a generally U-shaped resilient clamp 26 extending forwardly and defining a pair of curved portions 27 and 28. As is better seen in FIG. 5, curved portions 27 and 28 extend toward undersurface 13. Resilient clamp 26 is preferably formed of a spring-type or resilient material such that resilient clamp 26 provides a spring force urging clamp 26 toward undersurface 13. A paper stack 43, shown in dashed-line representation is receivable within storage bracket 20 and is captivated between undersurface 13 of palette base 11 and edge guides 24 and 25 as well as resilient clamp 26.

FIG. 5 sets forth a perspective view of the underside of the present invention paint palette and storage device. Device 10 includes a planar palette base 11 defining an undersurface 13. A storage bracket 20 includes sidewalls 21 and 22 and back wall 23 which secure bracket 20 to undersurface 13 of palette base 11. As described above, storage bracket 20 includes a pair of edge guides 24 and 25 extending inwardly from sidewalls 21 and 22 respectively together with a generally U-shaped resilient clamp 26. Clamp 26 includes a pair of curved bend portions 27 and 28 which extend clamp 26 downwardly toward undersurface 13. As is also described above, clamp 26 is preferably formed of a resilient material which provides a captivating force upon a paper stack 13 received within storage bracket 20. This resilient force operates to partially restrain the plurality of media sheets within paper stack 43 against undersurface 13 for convenient and reliable storage. In its preferred form, paper stack 43 comprises a plurality of individual paper sheets. However, it will be apparent to those skilled in the art that paper stack 43 may comprise a plurality of individual sheet forms of virtually any painting media suitable for use in a painting activity or the like.

In operation, the user is able to withdraw the desired sheet or numbers of sheets from stack 43 by simply grasping the end portions thereof and drawing them outwardly from bracket 20 in the direction indicated by arrow 47. The spring character of resilient clamp 26 maintains the remaining sheets of media within stack 43 in a reliable storage. In addition, material may be added to stack 43 by simply grasping clamp 26 in a convenient manner and drawing it outwardly from undersurface 13 by applying sufficient force to overcome its resilient characteristic.

What has been shown is a combination paint palette and storage device which provides convenient storage of a plurality of paint applicators together with a quantity of sheet form paint media. The device shown further includes a convenient color mix display as well as a plurality of mixing recesses to facilitate color mixing. The device shown presents an attractive and interesting package for the amusement and entertainment of the child user while facilitating the artistic activities of the user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A combination paint palette and storage device comprising:

a generally planar palette base defining an upper surface, a lower surface and a plurality of simulated paint deposits formed on said upper surface each defining a generally spherical socket recess;

a plurality of paint applicators each having applicator tips;

a color mix display including a planar cover overlying a portion of said upper surface and defining a plurality of window apertures and a circular color wheel rotatably secured between said upper surface and said covering and having a plurality of colored areas spaced so as to be viewable through said window aperture; and a plurality of paint applicator receptacles pivotally secured to said palette base and configured to receive said applicator tips of said paint applicators each including a cooperating generally spherical end portion received within respective ones of said socket recesses.

2. A combination paint palette and storage device comprising:

a generally planar palette base defining an upper surface, a lower surface and a plurality of simulated paint deposits formed on said upper surface each defining a generally spherical socket recess;

a sheet media storage bracket supported upon said undersurface of said palette base;

a plurality of paint applicators each having applicator tips; and a plurality of paint applicator receptacles pivotally secured to said palette base and configured to receive said applicator tips of said paint applicators each including a cooperating generally spherical end portion received within respective ones of said socket recesses.

3. A combination paint palette and storage device as set forth in claim 2 further including a color mix display including:

a planar cover overlying a portion of said upper surface and defining a plurality of window apertures; and a circular color wheel rotatably secured between said upper surface and said covering and having a plurality of colored areas spaced so as to be viewable through said window aperture.

4. A combination paint palette and storage device comprising:

a generally planar palette base defining an upper surface and a lower surface;

a plurality of paint applicators each having applicator tips; and a plurality of paint applicator receptacles pivotally secured to said palette base and configured to receive said applicator tips of said paint applicators;

a planar cover overlying a portion of said upper surface and defining a plurality of window apertures; and a circular color wheel rotatably secured between said upper surface and said covering and having a plurality of colored areas spaced so as to be viewable through said window aperture.

5. A combination paint palette and storage device comprising:

a generally planar palette base defining an upper surface and a lower surface;

a sheet media storage bracket supported upon said undersurface of said palette base;

a plurality of paint applicators each having applicator tips; and a plurality of paint applicator receptacles pivotally secured to said palette base and configured to receive said applicator tips of said paint applicators.

* * * * *